United States Patent [19]

Crystal et al.

[11] 4,327,639

[45] May 4, 1982

[54] PRINT HAMMER ASSEMBLY WITH MULTI-LOCATION IMPACTS

[75] Inventors: Richard G. Crystal, Los Altos; Andrew Gabor, Alamo; Enrique J. Klein, Los Altos, all of Calif.

[73] Assignee: Xerox Corporation, Stamford, Conn.

[21] Appl. No.: 91,605

[22] Filed: Nov. 5, 1979

[51] Int. Cl.[3] ..... B41J 9/30

[52] U.S. Cl. ..... 101/93.34; 101/93.48; 400/157.3; 400/144.2

[58] Field of Search ..... 101/93.02, 93.03, 93.19, 101/93.29–93.31, 93.48; 400/166, 157.3, 210, 304, 385–389, 424, 454–455, 144.2, 144.3

[56] References Cited

U.S. PATENT DOCUMENTS

| | | | |
|---|---|---|---|
| 2,326,604 | 8/1943 | Barish | 101/32 |
| 2,339,199 | 1/1944 | Smith | 101/19 |
| 3,543,906 | 12/1970 | Hladky | 101/93.29 |
| 3,670,647 | 6/1972 | Funk et al. | 101/426 |
| 3,741,113 | 6/1973 | Mako et al. | 101/93.02 |
| 3,780,648 | 12/1973 | Curtiss et al. | 101/93 C |
| 3,804,009 | 4/1974 | Blume | 101/93 C |
| 3,905,294 | 9/1975 | Barrus et al. | 101/93.48 |
| 3,918,568 | 11/1975 | Shimodaira | 197/49 |
| 3,968,744 | 7/1976 | Kasu et al. | 101/93.48 X |
| 3,998,153 | 12/1976 | Erhardt et al. | 101/93.29 X |
| 4,037,532 | 7/1977 | Plaza et al. | 101/93.48 |
| 4,106,406 | 8/1978 | Angelichio et al. | 101/93.31 |
| 4,114,532 | 9/1978 | Arzoumanian | 101/93.48 |
| 4,141,290 | 2/1979 | Hasler et al. | 101/93.48 |
| 4,189,997 | 2/1980 | Nozaki et al. | 101/93.09 |
| 4,200,043 | 4/1980 | Nozaki et al. | 101/93.29 |

FOREIGN PATENT DOCUMENTS

| | | | |
|---|---|---|---|
| 483032 | 5/1952 | Canada | 101/93.02 |
| 2360323 | 12/1972 | Fed. Rep. of Germany | 101/93.03 |

OTHER PUBLICATIONS

Mulzet et al., IBM Tech. Discl. Bulletin, vol. 16, No. 11, Apr. 1974, pp. 3529–3531.

Dollenmayer et al., IBM Tech. Discl. Bulletin, vol. 21, No. 8, Jan. 1979, pp. 3057–3061.

Preisinger, IBM Tech. Discl. Bulletin, vol. 6, No. 1, Jun. 1963, p. 42.

Gilbert et al., IBM Tech. Discl. Bulletin, vol. 17, No. 3, Aug. 1974, pp. 780-14 781.

*Primary Examiner*—Edward M. Coven

*Attorney, Agent, or Firm*—Barry Paul Smith; Serge Abend

[57] ABSTRACT

A print hammer assembly is disclosed comprising a support structure having a plunger at a first location thereon, and means for movably mounting the support structure with its plunger adjacent an electromagnetic actuator capable of being selectively energized such that, when the actuator is energized, the resultant magnetic field acting upon the plunger will cause the plunger and thus the support structure to travel along predefined paths and predetermined speeds. A hammer element is coupled to the support structure at a second location thereon, and means coupled to the hammer element causes the hammer element to impact an adjacent platen or interposed print element against an adjacent platen more than once during travel of the pole piece along its predefined path. The means for causing includes means for altering the location of maximum impact force of the hammer element following initial impact thereof against the platen or the interposed print element against the platen.

5 Claims, 10 Drawing Figures

BEGIN HAMMER ADVANCE TOWARD SECOND STRIKE

BEGIN HAMMER REBOUND FROM SECOND STRIKE

PRINT HAMMER ASSEMBLY WITH MULTI-LOCATION IMPACTS

BACKGROUND OF THE INVENTION

This invention relates to print hammer assemblies and, more particularly, to print hammer assemblies used in impact serial printers of the type including a platen, a plurality of print elements and a marking medium interposed between the print elements and the platen. An example of an impact serial printer of this type is disclosed in U.S. Pat. No. 4,091,911, whereas an example of a print hammer assembly used in such a printer is disclosed in U.S. Pat. No. 4,037,532.

One problem with existing serial printers of the type disclosed in U.S. Pat. No. 4,091,911, which employ a rotatable print wheel mounted to a linearly movable carriage along with a print hammer assembly, the carriage being moved along a path parallel to the longitudinal axis of an adjacent cylindrical platen, has to do with misalignment of the platen. More specifically, the platen must be precisely aligned relative to the carriage such that the carriage path is parallel to the longitudinal axis of the platen. If this relationship is not true, the print elements of the wheel may impact the platen at other locations on the periphery, but not in alignment with the center line thereof during linear advancement of the carriage. For example, if the platen is inclined in a vertical plane from left to right, the top area of print elements impacting the left portion of the platen might be at least partially deleted, with the reverse being true with respect to impacts occurring at the right portion of the platen. This, of course, will lead to an uneven, and perhaps unintelligible print.

It would be desirable, therefore, to provide a print hammer assembly that would compensate for minor misalignments of the platen axis relative to the linear path of movement of the carriage to which the print hammer assembly and print elements are mounted.

SUMMARY OF THE INVENTION

In accordance with the present invention, a print hammer assembly is provided comprising a hammer element; a hammer actuator capable when energized of directing said hammer element under force toward an adjacent platen; and means coupled to said hammer element for altering the location of maximum impact force of said hammer element following initial impact of said hammer element against said platen or an interposed print element against said platen.

By altering the location of maximum impact force following initial impact, it will be appreciated that different portions of the print element will be forced against the platen at the maximum impact force, thereby providing a self-correcting feature for most minor misalignments. Altering the location of maximum impact force also serves to improve release of marking material from a marking medium interposed between the print element and platen, as well as to facilitate lift-off of the print element from the marking medium and platen following printing.

In accordance with the preferred embodiment, the hammer element is caused to impact an interposed print element against an adjacent platen more than once in response to a signel energization of the hammer actuator. In this arrangement, the hammer element can be directed to strike predominantly the lower portion of a print element during the initial impact thereof against the platen, followed by succeedingly higher portions for succeeding impacts. As indicated above, this arrangement will self-correct for most minor misalignments of the platen axis.

These and other aspects and advantages of the present invention will be described in more detail below with reference to the accompanying drawings.

DESCRIPTION OF THE PREFERRED EMBODIMENT

Figure 1:
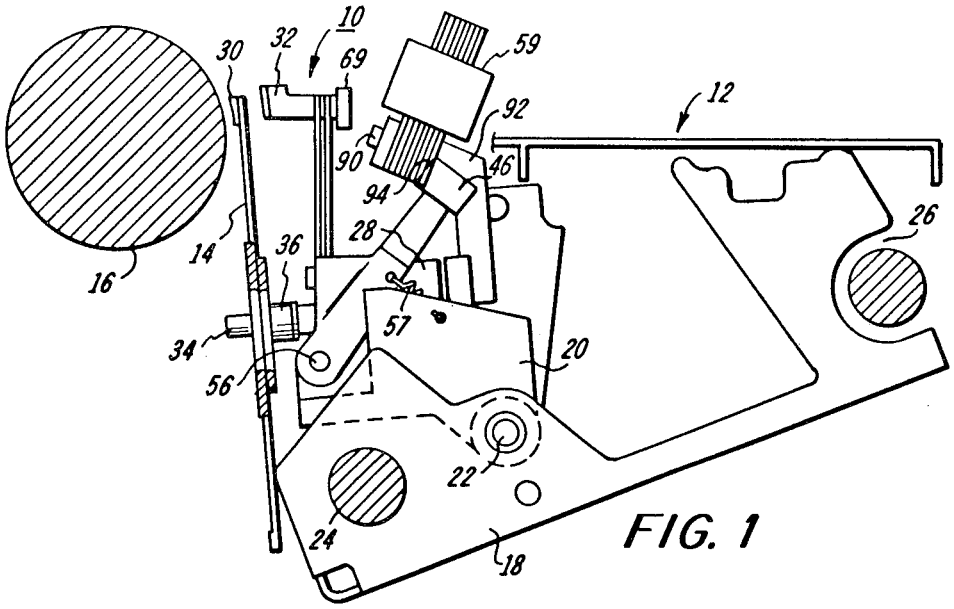
FIG. 1 is a partial side elevation view of an exemplary carriage assembly of a serial printer having mounted thereon a "daisy-wheel" print wheel and a hammer assembly, and being adapted to carry a ribbon cartridge (not shown)

A print hammer assembly 10 in accordance with the present invention is shown in FIG. 1 mounted to a carriage assembly 12, which may be of the general type disclosed in the aforementioned U.S. Pat. No. 4,037,532. The carriage assembly 12 is thus adapted to transport not only the hammer assembly 10, but also a rotatable print wheel 14 of the "daisy wheel" type and a ribbon cartridge (not shown) to selected positions along a predefined linear path parallel to the axis of rotation of a cylindrical support platen 16 mounted adjacent the carriage assembly 12.

The carriage assembly 12 comprises an outer carriage frame 18 and an inner carriage frame 20. The inner carriage frame 20 may be pivotably mounted to the outer carriage frame 18 by means of a suitable pivot bolt 22 extending through the side walls of the frames 18 and 20. The outer carriage frame 18 is preferably fixed in position in a manner to be described below, and the inner carriage frame 20 is pivotable about bolt 22 relative to frame 18. This pivoting action enables replacement and substitution of print wheels in a manner well known in the art. Suitable means (not shown) are provided for locking the inner carriage frame 20 in each of two positions, i.e., a print wheel loaded position (shown in FIG. 1) and a print wheel loading position (not shown), wherein the frame 20 would be pivoted clockwise relative to the position shown in FIG. 1.

As shown in FIG. 1, the outer carriage frame 18 has a pair of aligned openings 24 formed in the respective side walls of frame 18 adjacent the front end of the carriage assembly 12, and a pair of aligned recesses 26 formed in such respective side walls adjacent the rear end of the carriage assembly 12. The openings 24 and recesses 26 are each adapted to receive in locked relation a linear bearing assembly (not shown) which may be of the type disclosed in U.S. Pat. No. 3,985,404. The pair of linear bearing assemblies are adapted to receive a corresponding pair of guide rails (not shown) mounted parallel to the axis of the platen 16 and along which the carriage assembly 12 rides.

A print wheel motor 28 is mounted by suitable means (not shown) to the inner carriage frame 20. The motor 28 controls the speed and direction of rotation of the print wheel 14 in order to bring a desired print or character element 30 thereon to a stationary printing position in alignment with the platen 16 and a hammer element 32 included in the hammer assembly 10. The motor 28 has a shaft 34 projecting forwardly of the inner carriage frame 20. A hub portion 36 forms part of the shaft 34 and is adapted to be received in the central opening (not shown) of the print wheel 14. An exemplary print wheel is generally disclosed in U.S. Pat. No. 3,954,163.

Figure 2:
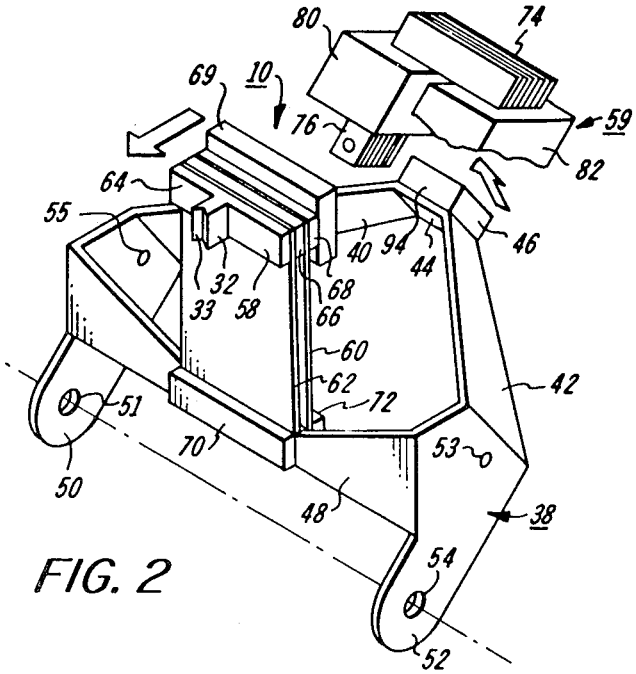
FIG. 2 is a front perspective view of the hammer assembly depicted in FIG. 1.
Figure 3:
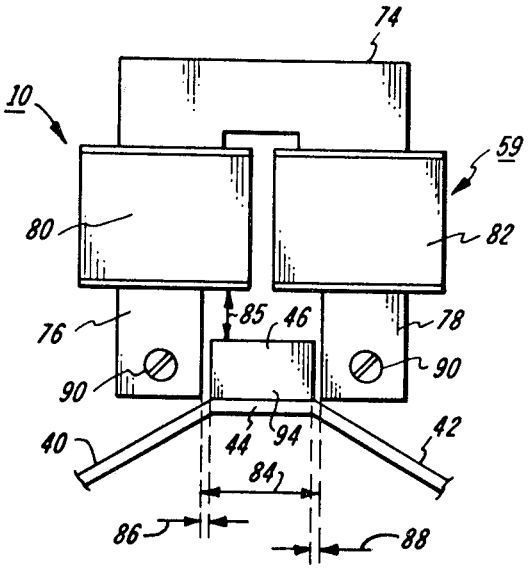
FIG. 3 is a front plan view of a portion of the hammer assembly as depicted in FIG. 2.

Also mounted to the inner carriage frame 20 by means to be described below is the hammer assembly 10 of the present invention. As best shown in FIGS. 2 and 3, the hammer assembly 10 includes a support structure or frame 38 which defines a first mass and is desirably of a generally trapezoidal shape with a pair of inwardly projecting finger portions 40 and 42 coupled at their upper ends by a bridge portion 44. Affixed to the outer surface of the bridge portion 44, or formed as an integral part thereof, is a plunger 46, which is desirably of a ferromagnetic material, such as soft iron. The finger portions 40 and 42 are coupled at their lower ends by a generally U-shaped attachment portion 48 having opposing side wall flange portions 50 and 52. The flange portions 50 and 52 include respective aligned openings 51 and 54 formed therein. The openings 51 and 54 are adapted to accommodate a pivot rod (not shown) that projects through both openings 51 and 54 and a corresponding pair of openings 56 (FIG. 1) in the side walls of the inner carriage frame 20. In this manner, the support frame 38 is pivotably mounted to the inner carriage frame 20.

The side wall flange portions 52 and 54 of the attachment portion 48 further include respective aligned openings 53 and 55 formed therein. Each such opening is adapted to retain an end of one of a pair of springs 57 (only one shown in FIG. 1). The other ends of the springs 57 are mounted to the inner frame 20. The springs 57 cooperate to bias the support frame 38 in a clockwise direction (as shown in FIG. 1) such that the support frame 38 is normally biased against a stop (not shown) also mounted to the inner frame 20. The support frame 38 may be pivoted counterclockwise about the pivot rod through openings 56 against the bias of springs 57 upon energization of an electromagnetic actuator 59 forming part of the hammmer assembly 10 in a manner to be described below.

Still referring to FIGS. 2 and 3, the hammer assembly 10 further includes the hammer element 32, which forms part of a second mass 58 that is coupled to the support frame 38 by at least one, and preferably two, leaf springs 60 and 62. The hammer element 32 preferably has a grooved impacting surface 33 that is matable with a corresponding wedge (not shown) formed on the rear surface of each character element 30. In this manner, minor misalignments between the hammer element and the selected character element can be corrected.

The second mass 58 includes three mounting blocks 64, 66 and 68, which are preferably of identical material, and a counter-balanced weight 69 affixed to the mounting block 68. The hammer element 32 projects forwardly from the center of a side surface of the block 64. In the embodiment shown in FIGS. 1–6, the leaf springs 60 and 62 are substantially identical and normally planar, and are spaced apart in parallel relationship. Additionally, the mounting blocks 64, 66 and 68 are substantially identical in dimensions, except for the hammer element 32 projecting from the mounting block 64. The upper end of the spring 60 is disposed between the mounting blocks 66 and 68, while the upper end of the spring 62 is disposed between the mounting blocks 64 and 66. The lower ends of the springs 60 and 62 are mounted on either side of the attachment portion 48 substantially centered between the side wall flange portions 52 and 54. A pair of mounting blocks 70 and 72 are attached to the lower ends of the springs 60 and 62 and hold them by suitable fastening means (not shown) against the attachment portion 48 of the support frame 38.

Referring to FIGS. 1–3, the hammer assembly 10 further includes the electromagnetic actuator or solenoid 59. The solenoid 59 has a C-shaped yoke 74 with a pair of depending legs 76 and 78 each containing an electrically conductive coil 80 and 82, respectively, mounted thereon. The space 84 between the portion of each leg 76 and 78 projecting downwardly from the respective coil 80 and 82 mounted thereon is of sufficient dimensions to accommodate the plunger 46 therein as shown in FIG. 3. With the plunger 46 positioned within the space 84, gaps 86 and 88 are defined between the sides of the plunger 46 and the adjacent legs 76 and 78, respectively. It is a feature of the present invention that the gaps 86 and 88 need not be identical in dimensions, thereby reducing the necessity of critical adjustments with respect thereto. Additionally, the spacing 85 between the upper surface of the plunger 46 and the lower surfaces of the coils 80 and 82 is not critical. The reasons for these non-critical relationships will be described in more detail below.

As shown in FIGS. 1 and 3, the solenoid 59 is mounted to the inner carriage frame 20 by affixing, through a pair of screws 90, the legs 76 and 78 to a solenoid frame 92, which is itself affixed by means (not shown) to the side walls of the inner carriage frame 20. The support frame 38 and solenoid 59 are normally positioned relative to one another such that a front surface 94 of the plunger 46 normally lies just to the rear of the legs 76 and 78 in alignment with the space 84. In this manner, when the solenoid 59 is energized by passing current through the coils 80 and 82 (clockwise flow through coil 80 and counterclockwise flow through coil 82), the resultant magnetic field established through the space 84 and acting upon the plunger 46 will force such plunger against the bias of the springs 57 through the space 84. This forward movement of the plunger 46 through the space 84 will cause a resultant pivotal movement of the support frame 38 about the pivot rod 56 and thus forward arcuate movement of the hammer element 32 toward the adjacent print element 30 and platen 16.

The operation of the embodiment of the invention as depicted in FIGS. 1–6 will now be described with respect to FIGS. 1 and 4–6. Prior to energization of the solenoid 59, the support frame 38 is in the position shown in FIG. 1, with the plunger 46 just slightly rearward of the legs 76 and 78 of the solenoid 59, and with the hammer element 32 spaced rearwardly of the aligned print element 30 of the print wheel 14. It is important that the solenoid 59 be energized for a time period sufficient to cause the plunger 46 to overtravel relative to the point along its path of travel at which the print element 30 and interposed marking medium are initially impacted by the hammer element 32 against the platen 16. This relationship increases the quantity of marking material released, as will be explained in more detail below.

Figure 4:
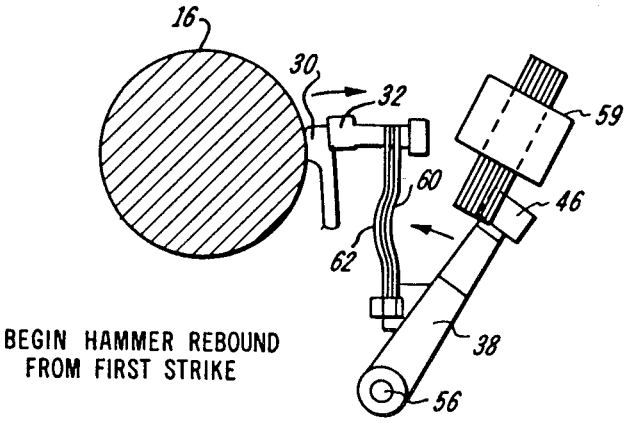
FIG. 4 is a partial side elevation view of the hammer assembly, print wheel and platen as depicted in FIG. 1, showing the hammer assembly upon retraction from a first impact.

Following energization of the solenoid 59, the plunger 46 begins to move through the space 84, thereby causing the support frame 38 to pivot about rod 56 and thus hammer element 32 to move toward the platen 16. During continued movement of the support frame 38, the hammer element 32 will engage the rear surface of the print element 30 and being forcing it toward the platen. Eventually, the hammer element 32 will force the print element 30 and an interposed marking medium and record medium, such as an inked ribbon and paper (both not shown), against the platen 16. When this occurs, and due to the overtravel relationship as identified above, the plunger 46 will have moved only partially through the space 84, as shown in FIG. 4.

Upon impact of the print element 30 against the platen 16 due to the force of the hammer element 32, the hammer element 32 and print element 30 will experience a first rebound from the platen. The start of the first rebound condition is also shown in FIG. 4. It is to be noted, however, that the plunger 46 will continue to travel in a forward direction due to the dynamics of the dual mass-spring configuration, notwithstanding the rebound action of the hammer element 32. It should be apparent that the hammer element 32 is capable of rebounding while the support frame and thus the plunger 46 continue to travel forwardly, due to the action of the springs 60 and 62.

Now then, the hammer element 32, and thus print element 30, will each experience a first rebound a predetermined distance from the platen 16. The rebound distance of the hammer element 32 is determined by the stiffness and length of the springs 60 and 62, as well as by the ratio of the two masses separated by the springs 60 and 62, and the force of impact, whereas the rebound of the print element 30 is determined by the resiliency of the print wheel spoke bearing the print element 30 and the force of impact.

Figure 5:
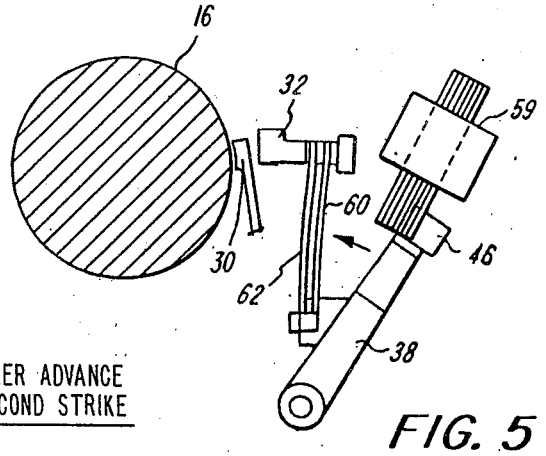
FIG. 5 is the same view as FIG. 4, but this time showing the hammer assembly upon advancement toward a second impact.
Figure 6:
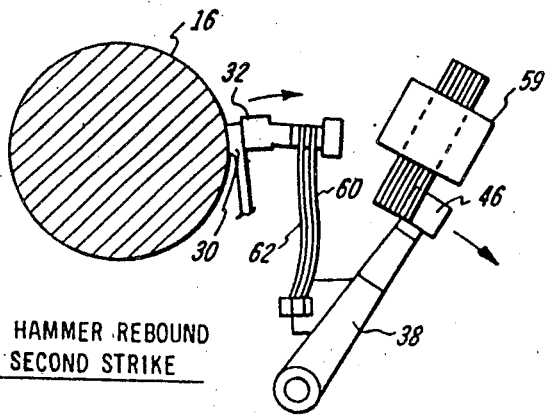
FIG. 6 is the same view as FIGS. 4 and 5, but this time showing the hammer assembly upon retraction from the second impact.

After the hammer element 32 has completed its first rebound, the now "cocked" springs 60 and 62 will cause the hammer element 32 to again advance in the direction of the platen 16, as shown in FIG. 5. At the instant of beginning advancement of the hammer element 32 toward the platen 16, the plunger 46 and support frame 38 are essentially at rest, as also shown in FIG. 5. Due to the action of the springs 60 and 62, the hammer element 32 will again force the print element 30 and interposed marking medium against the platen 16. This condition is depicted in FIG. 6. During advancement of the hammer element 32 toward the second impact, the plunger 46 will begin to retract in a clockwise direction. Following the second impact, the hammer element 32 will rebound a second time, mainly due to the energy released after impact by the viscoelastic material of platen 16. Additionally, the plunger 46 and thus support frame 38 will continue their retract due to the bias of the springs 57 and prior de-energization of the solenoid 59. It must be made clear that the solenoid 59 can be de-energized at any point in time following initial energization, provided the forward driving force imparted to the hammer element 32 is sufficient to achieve the desired multi-impact and consequent desired release of marking material.

If desired, the overall dwell time of the print element 30 against the platen 16 may be increased by continuously energizing the solenoid 59, including for a finite time after the second impact, thereby further increasing the total quantity of marking material (e.g., ink) released. The dwell time of the first impact may also be increased by stiffening the springs 60 and 62 or increasing the mass of the hammer element 32 and/or the plunger 46. If desired, the springs 60 and 62 may be made stiff enough so that there is no rebound of the hammer element 32 at all following initial impact. In accordance with the preferred embodiment, however, two distinct impacts are preferred. It will still be appreciated, however, that the overall dwell time is increased by two or more impacts over that which would normally be achieved by a single impact of the prior art hammer assembly disclosed in U.S. Pat. No. 4,037,532, since the hammer element of that assembly would immediately rebound following impact. The overall impact time during which marking material is released is obviously greater during a multiple impact condition than a single impact with immediate rebound thereof.

The capability of increasing the overall dwell time, and more importantly increasing the overall quantity of marking material released, has resulted in the capability of reducing the required level of impact force per hit. This has the direct advantage of being able to use somewhat less durable, but considerably lower cost print elements, such as all plastic print wheels, as opposed to metallic or composite metal/plastic wheels, while maintaining high print quality through multi-impacts, and resultant increased overall dwell time and thus increased overall release of marking material. The overall print noise is also reduced without sacrificing print quality.

Referring again to FIGS. 2 and 3, it will be appreciated that when current is made to flow clockwise through the coil 80 and counterclockwise through coil 82, a resultant magnetic field will be established through the space 84 to force plunger 46 in the direction shown by the arrow in FIG. 2. The level of force is related to the addition of the sizes of gaps 86 and 88 and the geometry of the plunger 46. Thus, it makes no difference if one of these two gaps is larger in size than the other, since their sum will always be equal, thereby maintaining a desired level of force through the space 84. The need for critical adjustments of the support frame 38 to achieve size identity of the gaps 86 and 88 is thus reduced. Additionally, and as pointed out earlier, the need for critical adjustments of the spacing 85 (FIG. 3) is also reduced.

It will also be appreciated that the magnetic force driving the plunger 46 through the gap 84 is more uniform than that achieved in the prior art assembly of U.S. Pat. No. 4,037,532. Specifically, in such prior art assembly, the force was inversly proportional to the square of the distance between a solenoid armature and the rear surface of a hammer actuator element. Further, considerable energy had to be expended to obtain the requisite hammer force level upon impact, due to this relationship. In the hammer assembly 10, no armature is used to impact the hammer element 32 and propel it toward the plate 16. As a result of the "sweeping gap" approach, the hammer element 32 is able to experience maximum acceleration early in the stroke, thereby more rapidly attaining the desired impact velocity and thus cutting down the flight time. The peak impact force may also be reduced due to the increased overall dwell time occassioned by multiple impacts, and thus consequent increased marking material release, as mentioned above.

Figure 9:
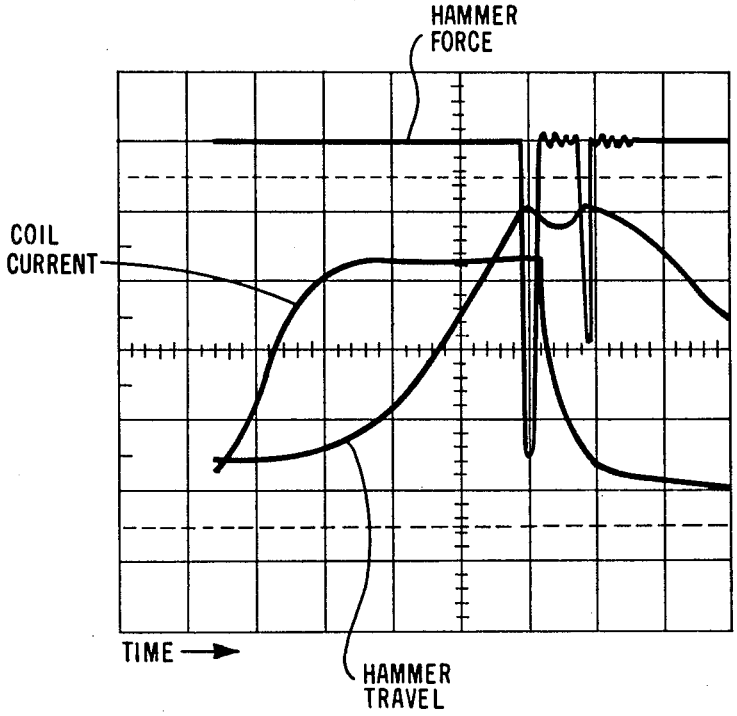
FIGS. 9 and 10 are oscilloscope traces showing the relative relationships among travel of the hammer element, actuator coil current, impact force of the hammer element, and time.
Figure 10:
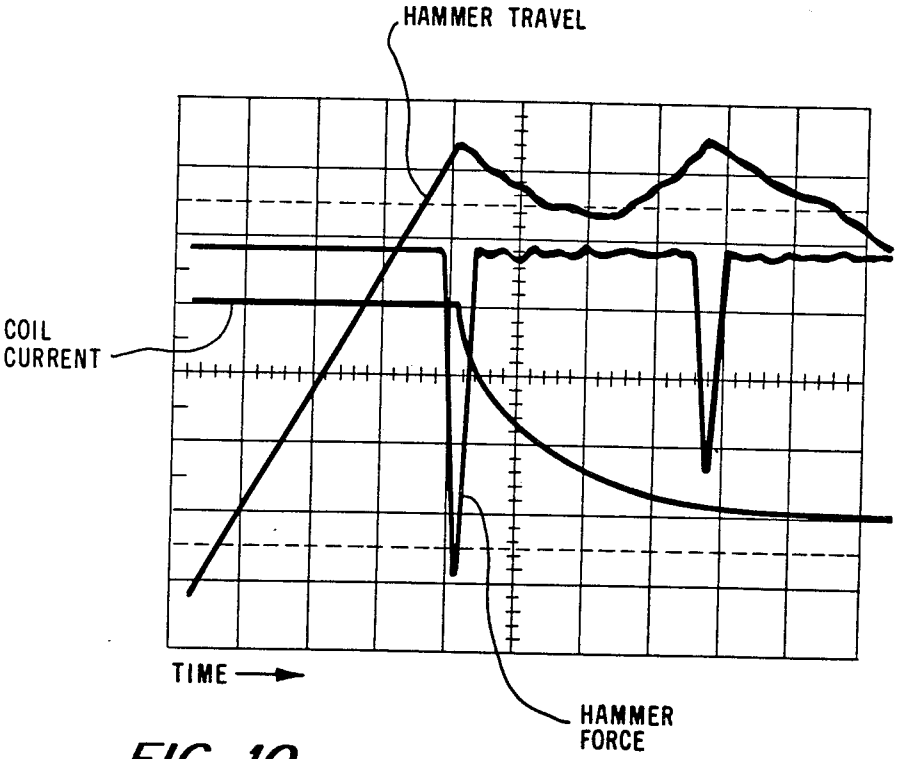

Oscilloscope traces showing the relationships among travel of the hammer element 32, level of current flow through the coils 80 and 82, level of impact force by the hammer element 32, and time, are shown in FIGS. 9 and 10. Hammer element travel was measured with an optoelectric device in which hammer element movement is proportional to output voltage, as shown in FIGS. 9 and 10. Current flow was measured with a current probe measuring current through the solenoid coils 80 and 82. Lastly, impact force was measured by a piezoelectric force transducer positioned beneath the platen covering.

Figure 7:
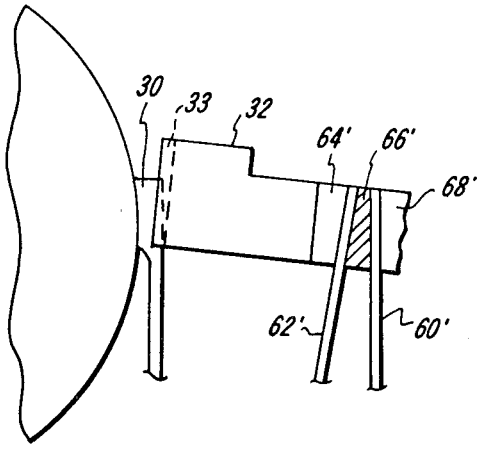
FIG. 7 is a partial side elevation view of a modified hammer assembly, together with an adjacent print wheel and platen, showing the hammer assembly during a first impact.
Figure 8:
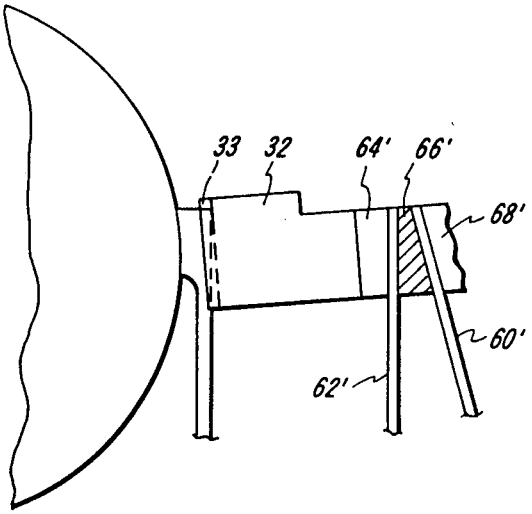
FIG. 8 is the same view as FIG. 7, but this time showing the hammer assembly during a second impact.

Yet another feature of the hammer assembly 10 is occassioned by the parallelogram defined by the pair of parallel springs 60 and 62 connected at one end to the mass 58, which includes the hammer element 32, and at its other end to the attachment portion 48 of the support frame 38, which defines an additional mass. By reason of this parallelogram and the action of the springs 60 and 62 in relation to the two masses, it was discovered that the hammer element 32 cound impact the print element 30 against the platen 16 at different impact angles for each of the multiple (e.g., two) impacts as described above. Whether or not this "heel-toe" effect actually takes places depends upon the stiffness of the leaf springs 60 and 62 and the overall relationship of the springs to the two masses to which they are connected. When the springs are chosen to provide the so-called "heel-toe" effect, there is a counterclockwise movement of the tip of the hammer element 32 following the initial impact and just prior to the second impact. This movement may be amplified by offsetting the springs 60 and 62 further apart at their lower ends than at their upper ends. A somewhat exaggerated example of the latter relationship is shown by springs 60' and 62' in FIGS. 7 and 8. In this embodiment, the springs 60' and 62' are interposed at their upper ends between mounting blocks 64', 66' and 68'. A trapezoidal configuration is thus defined by the springs 60' and 62', mounting blocks 64', 66' and 68', and the attachment portion 48 of the support frame 38 to which the lower ends of the springs 60' and 62' are mounted by suitable interposed mounting blocks (not shown). This trapezoidal shape has been found to amplify the counter-clockwise movement, or "heel-toe" effect.

By reason of the heel-toe effect achieved by either of the two embodiments, it is possible to mount the support frame 38 in such a manner that the hammer element 32 will initially impact predominantly the lower portion of the print element 30, while striking predominantly the upper portion of the print element 30 during the second impact. It should be appreciated, however, that the importance in this relationship is not necessarily in altering the location of impact by the hammer element 32 against the print element 30, but rather altering the location of maximum impact force of the print element 30 against the platen 16. Thus, altering the location of impact of the hammer element 32 against the print element 30 is but one way of achieving the desired result.

The heel-toe effect reduces the need for critical adjustments of the platen 16 to insure that its axis of rotation is completely parallel to the rails (not shown) on which the carriage assembly 12 rides. For example, if the platen axis is skewed relative to the rails in a vertical direction, the top half of characters might not be printed at one end of the paper, while the bottom half might be deleted from the other end. By striking each print element twice, once low and once high, minor misalignments in a vertical direction will be compensated for in the embodiment of FIGS. 1–6, and more major misalignments will be compensated for in the embodiment of FIGS. 7 and 8.

Although the invention has been described with respect to a presently preferred embodiment, it will be appreciated by those skilled in the art the various modifications, substitutions, etc. may be made without departing from the spirit and scope of the invention as defined in and by the following claims. For example, although the use of a pair of leaf springs is presently preferred, a single or more than two leaf springs may be employed.

What is claimed is:

1. A print hammer assembly for use with a platen upon which a record receiving member may be supported, a movable print element bearing a plurality of print characters, and means for moving said print element from character to character and for stopping said print element for impaction, said hammer assembly comprising:

a hammer element;

hammer actuator means for moving said hammer element under force toward said platen and against said print element, when said actuator means is energized; and spring means coupled to said hammer element for causing said hammer element to impact said print element more than one time for each energization of said hammer actuator means and for altering the location of maximum impact force of said hammer element following initial impact of said hammer element.

2. The print hammer assembly of claim 1, wherein said spring means is connected to a support structure at one end and to said hammer element at its other end.

3. The print hammer assembly of claim 2, wherein said spring assembly includes a pair of leaf springs.

4. The print hammer assembly of claim 4, wherein said pair of leaf springs are adjacent and parallel.

5. The print hammer assembly of any one of claims 2, 3 or 4, wherein said hammer actuator means includes a driving electromagnetic actuator and said support structure includes a plunger at a first location thereon, said plunger being positioned to be driven by said actuator, said support structure being movably mounted adjacent said actuator such that, when said actuator means is energized, the resultant magnetic field acting upon said plunger will cause said plunger, said support structure and said hammer element to travel along predefined paths at predetermined speeds.

* * * * *